United States Patent [19]

Dini

[11] 3,964,386

[45] June 22, 1976

[54] METHOD AND APPARATUS FOR REMOVING SURPLUS INK ON PRINTING CYLINDERS

[75] Inventor: Mamiliano Dini, Island of Elba, Italy

[73] Assignee: European Rotogravure Association, Munich, Germany

[22] Filed: Nov. 14, 1973

[21] Appl. No.: 415,788

[30] Foreign Application Priority Data

Dec. 11, 1972 Germany ..... 2257102

[52] U.S. Cl. ..... 101/169; 101/170; 15/256.5; 259/DIG. 44; 310/36; 318/129

[51] Int. Cl.[2] ..... B41F 35/00; A46B 15/00

[58] Field of Search ..... 101/157, 169, 170; 15/256.51, 256.50, 256.53; 259/DIG. 15, DIG. 44; 310/27, 29, 36; 318/114, 124, 129; 118/57, 120

[56] References Cited

UNITED STATES PATENTS

| | | | |
|---|---|---|---|
| 2,323,441 | 7/1943 | Baird | 318/124 |
| 2,910,040 | 10/1959 | Agahd | 118/120 |
| 3,087,184 | 4/1963 | Ljungquist | 15/256.51 |
| 3,113,225 | 12/1963 | Kleesattel et al. | 101/350 X |
| 3,238,397 | 3/1966 | Maness | 318/124 X |
| 3,301,535 | 1/1967 | Brown | 68/3.55 X |
| 3,389,655 | 6/1968 | Lorenz et al. | 101/169 X |
| 3,518,463 | 6/1970 | Abbot | 318/124 X |
| 3,730,087 | 5/1973 | Trant | 101/169 |
| 3,747,560 | 7/1973 | Roberts et al. | 118/57 |

FOREIGN PATENTS OR APPLICATIONS

| | | | |
|---|---|---|---|
| 1,169,961 | 5/1964 | Germany | 101/169 |

*Primary Examiner*—E. H. Eickholt
*Attorney, Agent, or Firm*—Cushman, Darby & Cushman

[57] ABSTRACT

A method and apparatus for removing surplus ink from the surface of rotogravure printing cylinders by providing a doctor blade apparatus having an edge adjacent to but spaced from the surface of a rotating printing cylinder. The printing cylinder carries surplus ink and the doctor blade apparatus is disposed at some angle $\alpha$ with respect to a tangent to the printing cylinder and functions to remove all but a residual portion of the ink on the printing cylinder. To achieve this, the doctor blade is oscillated at a frequency sufficient to create a hydrodynamic barrier in the ink layer. This hydrodynamic barrier or turbulence in the ink layer at the doctor blade apparatus serves as a barrier for blocking passage of all but a predetermined desired residual portion of the ink layer past the oscillating edge of the doctor blade apparatus. The doctor blade apparatus can take many forms and can be oscillated in any desired manner. In accordance with one preferred embodiment, the doctor blade apparatus comprises an electrical coil to which an electrical signal is applied. Magnetic field creating means are disposed adjacent the electrical coil and either the magnetic field or the electrical signal in the electrical coil is varied to create oscillating movement of the doctor blade apparatus.

11 Claims, 4 Drawing Figures

METHOD AND APPARATUS FOR REMOVING SURPLUS INK ON PRINTING CYLINDERS

BACKGROUND OF THE INVENTION

This invention pertains to rotogravure printing and, more particularly, pertains to a method and apparatus for removing surplus ink from the surface of a rotogravure printing cylinder.

In conventional doctor blade rotogravure printing techniques, ink is delivered in a surplus amount from an ink pot onto the surface of a rotogravure printing cylinder. A doctor blade is provided to strip off from the cylinder surface that surplus ink transferred from the ink pot to the printing cylinder which does not fill out the engraving cells on the cylinder. The doctor blade is typically mounted on a doctor blade holder and the doctor blade is pressed against the cylinder surface under a prescribed angle and under a pressure which can be controlled either in a mechanical or pneumatic fashion. It is known in the prior art to impart to the doctor blade an oscillatory movement in the direction of its working edge, i.e. on a parallel with the cylinder axis. Typically, the frequency of such oscillatory movement imparted to the doctor blade is related to the number of cylinder revolutions in a ratio of, for example, 1:16,666.

Use of a doctor blade as described above which mechanically bears against the surface of the printing cylinder leads to many problems. Thus, wear of the doctor blade and/or the cylinder surface, even in situations where the cylinder surface is provided with a hard chromium coating, occurs. There also occurs uneven wiping off of surplus ink due to non-uniform coordination of the positions of the doctor blade and the cylinder as well as line scratches on the printing cylinder surface due to particles of foreign bodies trapped at the doctor blade wiping edge. The consequences of these above-mentioned irregularities in operation are frequent shutdowns of the printing machine for the purpose of readjustment of the position and of eventual replacement of the doctor blade. Further, there arise problems of maintaining the doctor blade pressure at a desired level and, under given circumstances, inconstancy of tone reproduction of printings by the printing cylinder due to modification of the angular position of the doctor blade and of the geometry of its angle.

OBJECTS AND SUMMARY OF THE INVENTION

Accordingly, it is an object of this invention to provide a method and means for removing excess ink from the surface of a printing cylinder not subject to the above-mentioned disadvantages.

It is a more specific object of this invention to provide a method and means for removing surplus ink from the surface of a printing cylinder which does not necessitate any mechanical contact between a doctor blade and the surface of a printing cylinder.

Briefly, in accordance with one embodiment of the invention, excess or surplus ink is removed from the surface of a printing cylinder by a doctor blade which is provided having an edge adjacent to but spaced from the surface of the printing cylinder. The doctor blade edge is oscillated to create a hydrodynamic barrier in the ink layer which blocks passage of all but a predetermined residual portion of the ink layer past the doctor blade edge.

DESCRIPTION OF THE PREFERRED EMBODIMENTS

Figure 1:
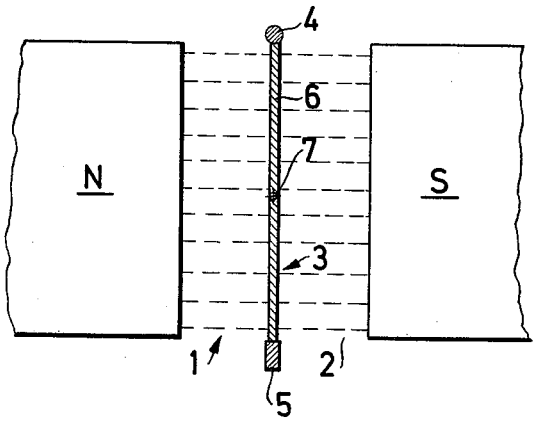
FIG. 1 is a schematic illustration of one doctor blade arrangement in accordance with the invention, wherein the doctor blade arrangement comprises a conductor loop.

As mentioned before, the present invention relates to a process and apparatus for removing the surplus ink delivered from an ink pot onto rotogravure printing cylinders by the aid of a doctor blade in which the thickness of the ink layer which remains on the surface of the printing cylinder after having passed a gap between the doctor blade and the printing cylinder surface is controlled by hydrodynamic damming forces generated within the ink layer by high frequency oscillations of a free edge of the doctor blade. For purposes of the present description, the term "doctor blade" has been retained in view of the fact that the apparatus of the invention fulfills the task in rotogravure printing techniques of restricting the coverage by ink of the surface of the printing cylinder to the filling up of the engraving cells. It should be appreciated, however, that the doctor blade in accordance with applicant's invention does not correspond to the usual solid construction of a doctor blade which is comparatively heavy in mass. Rather, in accordance with applicant's invention, the doctor blade apparatus which is provided may be described as a flat cantilever body of low mass which is clamped at one end to a doctor blade holder and which is oscillated around its clamped edge so that a free edge of the doctor blade is oscillated.

In accordance with a preferred embodiment of the invention, a doctor blade is oscillated within a frequency range of from 5 to 200 KHz, and preferably within the smaller range of 50 to 150 KHz. It should be recognized that the mass should be sufficiently low to permit oscillation at the frequency employed. Also, in accordance with an embodiment of the invention, the linear extent of the amplitude of oscillation of the free edge of the doctor blade is within the range 5 to 30 $\mu$, and preferably within the smaller range of 10 to 20 $\mu$. The ink layer which enters the region of influence of the oscillating edge of the doctor blade; that is, the gap zone between the edge of the doctor blade and the surface of the printing cylinder, is caused to oscillate by the oscillating edge of the doctor blade thereby creating turbulence within the ink layer. This turbulence is effective as a damming pressure at the upstream side, i.e. at the leading edge of the doctor blade, and thereby provides within the gap zone a hydrodynamic barrier for controlling the thickness of the ink layer. The extent or magnitude of the damming back effect depends on the consistency or density of the ink, the distance between the oscillating edge of the doctor blade and the surface of the printing cylinder, the frequency and/or amplitude of oscillation of the free oscillating edge of the doctor blade, and on the tangential angular position of the doctor blade plane relative to the cylinder surface, as well upon the extent to which the individual cells on the rotogravure printing cylinder are filled. The tangential angular position of the doctor blade plane relative to the cylinder surface also obviously determines the angular position of the vector of the damming forces to which the ink layer advancing towards the gap is subjected.

In accordance with the invention, the oscillating doctor blade may assume any of various configurations; all that is necessary is that the doctor blade include an edge adjacent to but spaced from the rotating surface of the printing cylinder and that the doctor blade, or at least the edge adjacent the printing cylinder, be oscillated. The doctor blade may thus be formed of oscillating rods and the like. Oscillation of the doctor blade may be produced utilizing any desired type of mechanical, pneumatic, piezoelectric or electromagnetic vibration arrangements which are known to those skilled in the art.

Figure 2:
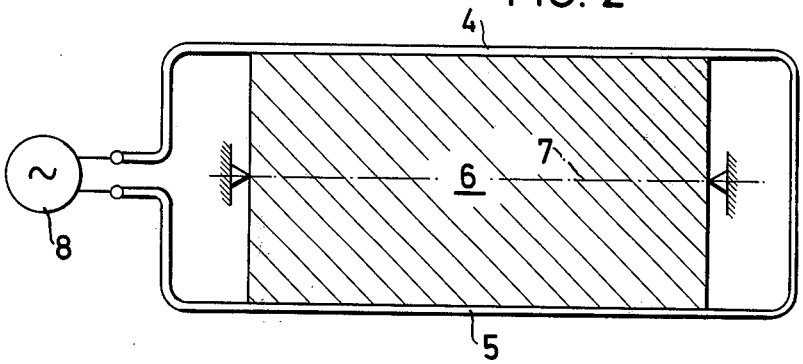
FIG. 2 is a schematic front view of the doctor blade illustrated in FIG. 1.

Turning now to a consideration of FIG. 1, together with FIG. 2, there is shown a schematic diagram of a doctor blade arrangement in accordance with one embodiment of the invention. In accordance with this embodiment there is provided a magnetic pole arrangement 1 including spaced poles N and S having an air gap 2 therebetween. The magnetic pole arrangement 1 may comprise strong permanent magnets or alternatively and preferably may comprise an electromagnet having a direct current applied thereto for creating a continuous magnetic field across the air gap 2. A doctor blade arrangement 3 is positioned in the air gap 2 between the magnetic poles N and S. The doctor blade arrangement 3 includes a conductor 4 and a conductor 5 which are electrically joined together and which are electrically coupled to an alternating current generator 8. The conductors 4 and 5 are connected to each other by a relatively light but rigid joint plate 6 which may, for example, be a thin metal plate suitably electrically insulated, of course, from the conductors 4 and 5. The rigid joint plate 6 is clamped or fixed along its central line 7. The rigid plate 6 may, for example, be clamped in the customary doctor blade holder provided adjacent a rotogravure printing cylinder.

Of the two conductors 4 and 5, the lower conductor 5 serves as the actual doctor blade edge and may be provided with an appropriate shape. Thus, the lower conductor 5 may in cross-section by square, rectangular, or provided with a tapering knife edge. The alternating current generator 8 applies an alternating current to the conductors 4 and 5, having a frequency in accordance with one embodiment of the invention between 5 and 200 KHz. Due to the presence of the magnetic field due to the magnetic pole arrangement 1, this alternating current flowing through the conductors 4 and 5 causes oscillation of the conductors 4 and 5 around the clamped axis 7. As mentioned before, this produces a oscillation or movement of the conductor 5 comprising the doctor blade edge within the range of 5 to 30 $\mu$. This oscillation creates the hydrodynamic force within the ink layer for blocking all but a predetermined portion of the ink layer from passing the conductor 5 constituting the doctor blade edge.

Figure 3:
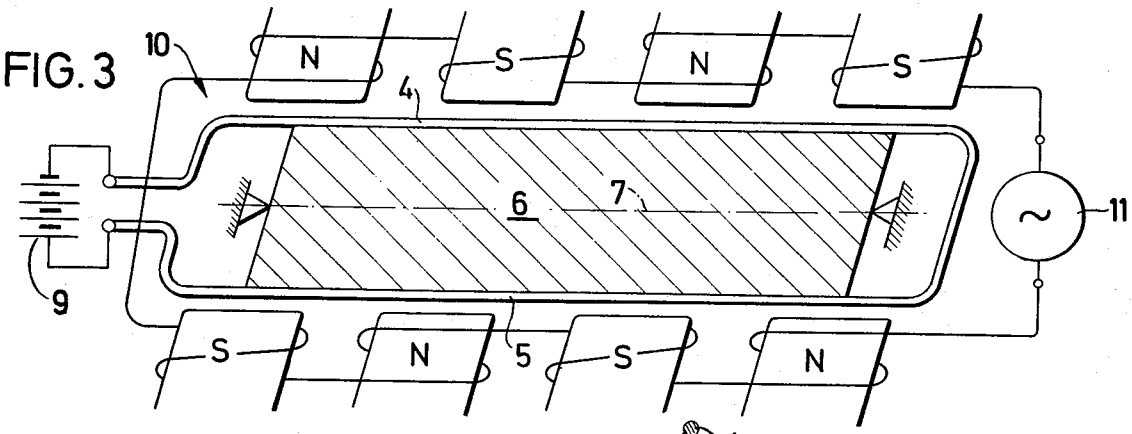
FIG. 3 schematically illustrates another embodiment of the invention wherein the doctor blade also comprises a conductor loop.

FIG. 3 illustrates a schematic alternate arrangement still utilizing electromagnetic forces for creating oscillation, but in which current flowing through the conductors comprising the doctor blade is a direct current and the magnetic field within which the doctor blade is positioned is an alternating magnetic field. Thus, in FIG. 3 the doctor blade comprising the conductors 4 and 5 is again clamped along its axis and a direct current is applied to the conductors 4 and 5 by means such as the direct current source 9. In the embodiment of FIG. 3, the magnetic pole arrangement 10 is shown to comprise a plurality of electromagnets spaced along the extent of the conductors 4 and 5 with each of the electromagnets having an air gap with opposed poles adjacent the air gap. The magnet arrangement 10 is energized by and driven by an alternating current source 11. The alternating current source 11 produces an alternating magnetic field across the air gap of the magnet arrangement 10 so that with the alternating magnetic field and the direct current electric field in the conductors 4 and 5, the conductors 4 and 5 oscillate. The arrangement of FIG. 3 thus produces the same kind of oscillations as the arrangement of FIGS. 1 and 2, except that in FIGS. 1 and 2 the magnetic field is constant and the electric field through the conductors 4 and 5 alternates; whereas in the arrangement of FIG. 3, the electric field associated with the conductors 4 and 5 is constant and the magnetic field is an alternating magnetic field.

Figure 4:
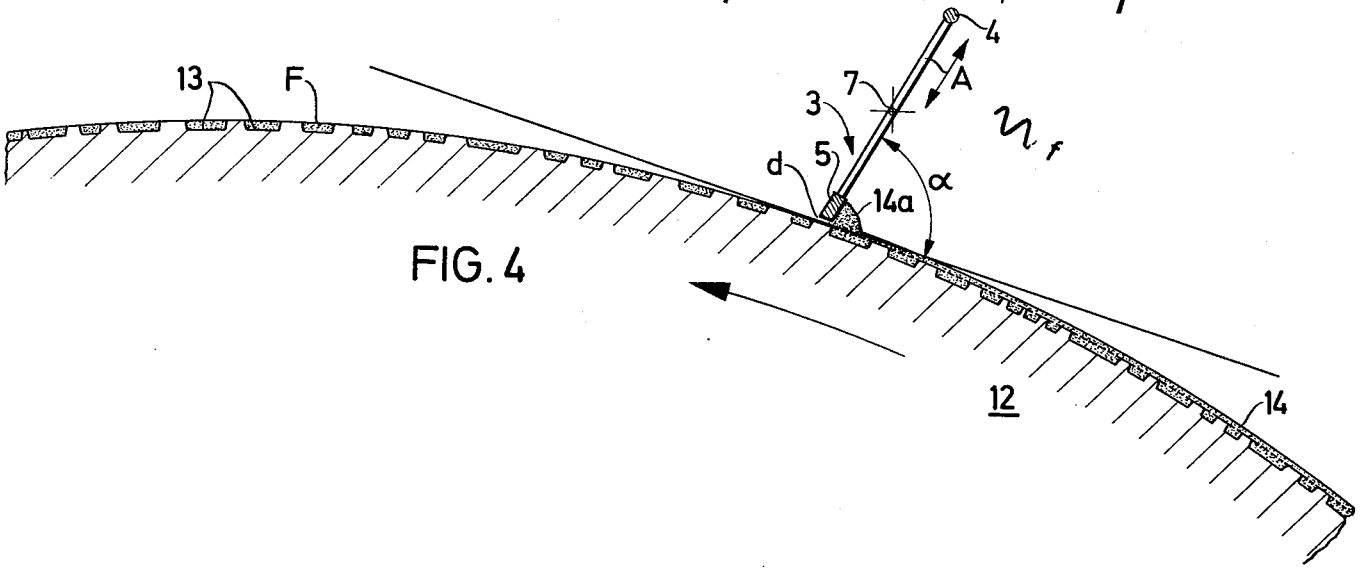
FIG. 4 is a schematic illustration of the position of a doctor blade in accordance with this invention in relation to the surface of a printing cylinder onto which a required ink coating is to applied.

Turning now to a consideration of FIG. 4, threre is shown a diagrammatic illustration of the mounting arrangement between a doctor blade constructed in accordance with this invention and a rotogravure printing cylinder. Referring to FIG. 4, a doctor blade 3 including the electrical conductors 4 and 5 is disposed adjacent a printing cylinder 12. The doctor blade 3 is disposed with its conductor 5 forming a doctor blade edge spaced a distance $d$ from the surface of a printing cylinder with the doctor blade 3 disposed at an angle $\alpha$ between the plane of the doctor blade 3 and the tangent to the printing cylinder at the point where the plane of the doctor blade intersects the printing cylinder. The printing cylinder 12 has a plurality of cells 13 formed in the surface thereof. A layer of ink 14 is deposited on the printing cylinder from means (not shown) such as inking pot. The oscillation of the lower conductor 5 forming a doctor blade edge creates turbulence in the ink layer 14 so as to form a hydrodynamic barrier indicated by reference numeral 14*a* adjacent the leading edge of the doctor blade edge 5. This hydrodynamic barrier has the effect of controlling the thickness of the ink layer which is allowed to remain on the printing cylinder 12 as the printing cylinder 12 rotates past the doctor blade edge 5. The amount of the hydrodynamic barrier effect or damming effect caused by the oscillating doctor blade depends upon the distance $d$ separating the surface of the printing cylinder and the doctor blade edge, as well as the angle $\alpha$ that the doctor blade is disposed with respect to a tangent to the printing cylinder. The amount of damming effect caused by the oscillating doctor blade 3 can also be controlled by suitable selection of the oscillation frequency $f$ and/or the oscillation amplitude A.

Thus, there has been described a method and apparatus for controlling the thickness of a liquid layer applied to a surface. The invention is applicable to any situation where it is desired to control the thickness of a liquid layer applied to a surface, but has been described herein with respect to a preferred embodiment, for rotogravure printing applications, for controlling the thickness of a layer of ink left on the printing cylinder. The invention has also been described with reference to particular preferred embodiments wherein oscillation of a doctor blade is achieved through the interaction of a magnetic field and an electrical field, one of which is alternating. The principles of the invention are equally applicable to situations where oscillation of a doctor blade is achieved through other means, such as by use of a piezoelectric crystal or by mechanical vibration means. It should be obvious that these and other modifications can be made to the particular preferred embodiments disclosed herein without departing from the true spirit and scope of the invention.

It should also be obvious to those skilled in the art that several oscillating doctor blades in accordance with this invention might be provided adjacent the surface of a single printing cylinder. For example, for a very long printing cylinder a plurality of oscillating doctor blades in accordance with this invention can be provided disposed end-to-end along the length of a printing cylinder. For such an arrangement the oscillations of the various oscillating doctor blades should be synchronized with one another for best results.

What is claimed is:

1. In a process wherein a layer of liquid is transferred onto a surface in a surplus amount and all but a predetermined residual portion of the liquid layer is stripped off, a method of stipping off all but the residual portion comprising the steps of:

providing a stripping member having a mass sufficiently low so as to permit rapid oscillation thereof, said stripping member also having a stripping edge adjacent to but at all times spaced from the surface by a predetermined distance, disposing said stripping edge in a plane generally parallel to a tangent plane of the surface, causing relative movement between the surface and the stripping member, and oscillating the stripping edge of said stripping member in a plane generally perpendicular to said tangent plane of the surface sufficiently so as to create a hydrodynamic barrier in the liquid layer to block passage of all but the residual portion of the liquid layer past the stripping edge.

2. A method in accordance with claim 1 wherein the oscillation of the stripping edge is carried out at a frequency between 5 and 200 KHz.

3. In a rotogravure printing process wherein ink is transferred from an inking pot to a rotating printing cylinder in surplus amount and all but a residual portion of the ink layer is stripped off, a method for stripping off the all but residual portion comprising providing a doctor blade having a mass sufficiently low so as to permit rapid oscillation thereof, said doctor blade also having a doctor blade edge adjacent to but at all times spaced from the surface of the rotating printing cylinder, and oscillating the doctor blade edge sufficiently so as to create a hydrodynamic barrier in the ink layer which blocks passage of all but the residual portion of the ink layer past the doctor blade edge.

4. A method in accordance with claim 3 wherein the oscillation of the doctor blade edge is carried out at a frequency between 5 and 200 KHz.

5. A method in accordance with claim 3 wherein the doctor blade edge is disposed at an angle $\alpha$ with respect to a tangent to the surface of the rotating printing cylinder and wherein the doctor blade edge is oscillated in the plane of the doctor blade at an angle $\alpha$ with the tangent to the printing cylinder surface.

6. A method in accordance with claim 5 wherein the linear extent of the oscillation amplitude of the doctor blade edge lies within the range of 5 to 30 $\mu$.

7. In a rotogravure printing apparatus including a rotating printing cylinder and ink supply means for applying a layer of ink in surplus amounts to the surface of the rotating printing cylinder, means for stripping from the printing cylinder surface all but a predetermined residual portion of the ink layer comprising a doctor blade having a mass sufficiently low so as too permit rapid oscillation thereof, said doctor blade also having a doctor blade edge adjacent to but at all times spaced from the surface of the printing cylinder, and means for oscillating the doctor blade whereby oscillating movement of the doctor blade edge creates a hydrodynamic barrier in the ink layer for blocking passage of all but a residual portion of the ink layer past the doctor blade edge.

8. Apparatus in accordance with claim 8 wherein said means for oscillating the doctor blade is operable at a predetermined frequency within the range 5 to 200 KHz.

9. Apparatus in accordance with claim 7 wherein said doctor blade comprises electrical conducting elements and including a mechanical element rigidly joining said electrical conducting elements, and wherein said means for oscillating the doctor blade comprises an electric current source for energizing the electrical conducting elements and further includes magnetic means for establishing a magnetic field across the doctor blade.

10. Apparatus in accordance with claim 9 wherein said electric current source comprises an alternating current source alternating within the frequency range 5 to 200 KHz. and wherein said magnetic means comprises means for creating a constant magnetic field.

11. Apparatus in accordance with claim 9 wherein said electric current source comprises a direct current source and wherein said magnetic means comprises means for creating an alternating magnetic field which alternates with a frequency in the range 5 to 200 KHz.

* * * * *

UNITED STATES PATENT OFFICE

CERTIFICATE OF CORRECTION

PATENT NO. : 3,964,386

DATED : June 22, 1976

INVENTOR(S) : Mamiliano Dini

It is certified that error appears in the above-identified patent and that said Letters Patent are hereby corrected as shown below:

On Cover Sheet Item [30] "Dec. 11, 1972" should read --Nov. 21, 1972--.

In column 6, claim 8, line 1, change "8" to --7--; and,

In claim 7, line 7, change "too" to --to--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*